US009896305B2

(12) United States Patent
Blandin et al.

(10) Patent No.: US 9,896,305 B2
(45) Date of Patent: Feb. 20, 2018

(54) PERSONALIZED ELEVATOR DISPATCH

(71) Applicant: International Business Machines Corporation, Armonk, NY (US)

(72) Inventors: Sebastien Blandin, Singapore (SG); Laura Wynter, Westport, CT (US)

(73) Assignee: International Business Machines Corporation, Armonk, NY (US)

( * ) Notice: Subject to any disclaimer, the term of this patent is extended or adjusted under 35 U.S.C. 154(b) by 255 days.

(21) Appl. No.: 14/706,578

(22) Filed: May 7, 2015

(65) Prior Publication Data

US 2016/0325962 A1 Nov. 10, 2016

(51) Int. Cl.

*B66B 1/34* (2006.01)
*B66B 1/46* (2006.01)
*B66B 3/00* (2006.01)

(52) U.S. Cl.

CPC ..... *B66B 1/468* (2013.01); *B66B 1/3461* (2013.01); *B66B 3/006* (2013.01); *B66B 2201/4615* (2013.01); *B66B 2201/4653* (2013.01)

(58) Field of Classification Search

CPC ..... B66B 1/468; B66B 1/3461; B66B 3/006; B66B 2201/4615; B66B 2201/4653
USPC ..... 187/382
See application file for complete search history.

(56) References Cited

U.S. PATENT DOCUMENTS 4,804,069 A 2/1989 Bittar et al.
5,022,497 A * 6/1991 Thanagavelu ..... B66B 1/2458 187/382
5,248,860 A * 9/1993 Sirag, Jr. ..... B66B 1/2408 187/380
5,260,526 A * 11/1993 Sirag, Jr. ..... B66B 1/2408 187/382
5,606,154 A 2/1997 Doigan et al.
5,854,454 A * 12/1998 Upender ..... H04L 12/40163 187/247
7,021,429 B2 * 4/2006 Hikita ..... B66B 1/462 187/391

(Continued)

FOREIGN PATENT DOCUMENTS

EP 0403232 A2 12/1990
EP 2183177 B1 3/2012

(Continued)

OTHER PUBLICATIONS

Beamurgia et al., "A Genetic Algorithm with Passenger Arrival Advanced Information to Solve the Elevator Dispatching Problem," WeD3—Heuristics I, AIRO 2011 Conference, Operational Research in Transportation and Logistics, Sep. 6-9, 2011, pp. 123-124, Brescia, Italy.

(Continued)

*Primary Examiner* — David Warren
(74) *Attorney, Agent, or Firm* — Laura E. Gisler

(57) ABSTRACT

A routing plan for elevator passengers can be developed by a computer system, when there are a plurality of elevator users requesting service from a plurality of elevators. The routing plan can be based on user input that specifies a destination and a current location. Profile data for each user can also be used to develop the routing plan. The input and profile data is correlated with a shared resource in each elevator, and the routing plan is developed from the correlated data. The plan is then communicated to the users.

20 Claims, 7 Drawing Sheets

(56) References Cited

U.S. PATENT DOCUMENTS

| | | | | |
|---|---|---|---|---|
| 7,610,995 | B2 * | 11/2009 | Ylinen | B66B 1/34 187/381 |
| 7,694,781 | B2 * | 4/2010 | Sorsa | B66B 1/2458 187/382 |
| 7,823,700 | B2 * | 11/2010 | Boss | B66B 1/468 187/247 |
| 8,028,806 | B2 | 10/2011 | Stanley et al. | |
| 8,342,292 | B2 * | 1/2013 | Demma | B66B 1/468 187/247 |
| 8,646,581 | B2 * | 2/2014 | Iwata | B66B 1/468 187/387 |
| 2006/0065491 | A1 * | 3/2006 | Zaharia | B66B 1/18 187/391 |
| 2007/0240943 | A1 * | 10/2007 | Gerstenkorn | B66B 3/00 187/391 |
| 2008/0236956 | A1 * | 10/2008 | Finschi | B66B 1/468 187/382 |
| 2012/0160612 | A1 | 6/2012 | de Groot | |
| 2012/0221412 | A1 * | 8/2012 | Gazdzinski | G06Q 30/0251 705/14.57 |
| 2012/0253658 | A1 * | 10/2012 | Kappeler | B66B 1/468 701/410 |
| 2012/0255813 | A1 | 10/2012 | Atalla et al. | |
| 2012/0305341 | A1 | 12/2012 | Kuoppala et al. | |
| 2013/0297093 | A1 * | 11/2013 | Nowel | B66B 1/468 700/299 |
| 2014/0054116 | A1 * | 2/2014 | Wu | B66B 5/0012 187/392 |
| 2016/0251199 | A1 | 9/2016 | Kronkvist et al. | |
| 2016/0304312 | A1 * | 10/2016 | Thompson | B66B 1/3423 |
| 2016/0325962 | A1 * | 11/2016 | Blandin | B66B 1/468 |
| 2016/0355375 | A1 * | 12/2016 | Simcik | B66B 1/468 |
| 2017/0088397 | A1 * | 3/2017 | Buckman | B66B 1/3461 |

FOREIGN PATENT DOCUMENTS

| | | | | |
|---|---|---|---|---|
| EP | 1779326 | B1 | 1/2013 | |
| FI | WO 0040496 | A1 * | 7/2000 | B66B 1/468 |
| WO | 2007061422 | A1 | 5/2007 | |
| WO | WO 2009123602 | A1 * | 10/2009 | B66B 1/2458 |
| WO | WO 2011102837 | A1 * | 8/2011 | B66B 1/2408 |
| WO | WO 2011106010 | A1 * | 9/2011 | B66B 1/2408 |
| WO | WO 2015191345 | A1 * | 12/2015 | B66B 1/468 |
| WO | WO 2016094491 | A1 * | 6/2016 | B66B 1/2408 |
| WO | 2016124538 | A1 | 8/2016 | |

OTHER PUBLICATIONS

Bruglieri et al., "A Variable Neighborhood Search for the University Carpooling," WeD3—Heuristics I, AIRO 2011 Conference, Operational Research in Transportation and Logistics, Sep. 6-9, 2011, pp. 125-126, Brescia, Italy.

Crites et al., "Improving Elevator Performance Using Reinforcement Learning," In Advances in Neural Information Processing Systems 8, MIT Press, Cambridge, MA, 1996, 7 pages.

Friese et al., "Online-optimization of multi-elevator transport systems with reoptimization algorithms based on set-partitioning models," Discrete Applied Mathematics 154 (2006), pp. 1908-1931, © 2006 Elsevier B.V. doi:10.1016/j.dam.2006.03.034.

Fulop et al., "Survey on Complex Event Processing and Predictive Analytics," Jul. 13, 2010, 59 pages.

Mahmood, T., "Learning Adapted Interaction Strategies in Conversational Recommender Systems," International Doctorate School in Information and Communication Technologies, PhD Dissertation, 226 pages, Mar. 2009.

Mell et al., "The NIST Definition of Cloud Computing," National Institute of Standards and Technology, U.S. Department of Commerce, Special Publication 800-145, Sep. 2011, 7 pages.

Moriarty, D., "Symbiotic Evolution of Neural Networks in Sequential Decision Tasks," Dissertation Presented to the Faculty of the Graduate School of the University of Texas at Austin, May 1997, 189 pages.

Pepyne et al., "Optimal Dispatching Control for Elevator Systems During Up Peak Traffic," Proceedings of the 35th Conference on Decision and Control, pp. 3837-3842, Dec. 1996, Kobe, Japan.

Ruokokoski et al., "Elevator Dispatching as Mixed Integer Linear Optimization Problem," INFORMS Annual Meeting, 15 pages, Oct. 2008.

Minkoff, A., "A Markov Decision Model and Decomposition Heuristic for Dynamic Vehicle Dispatching," Operations Research, vol. 41, No. 1, Special Issue on Stochastic and Dynamic Models in Transportation, Jan.-Feb. 1993, pp. 77-90.

* cited by examiner

PERSONALIZED ELEVATOR DISPATCH

BACKGROUND

The present disclosure relates to developing an elevator dispatch plan, and more specifically, to assigning users to elevators based on personalized data.

Elevators can transport people or goods between floors of a building. Elevators are generally powered by electrical motors, and they can be controlled by destination control systems. These systems are often found in skyscrapers, and they allow passengers to register their floor calls before entering a car. These systems can be used to decrease travel and waiting time for passengers. These systems can direct a plurality of users and a plurality of elevators, and thus become fairly complex systems.

SUMMARY

Embodiments of the present disclosure may be directed toward a computer implemented method for developing a routing plan for a plurality of users requesting elevator service from a plurality of elevators. The elevator routing plan can be developed from user input specifying a destination and a current location received from each user in the plurality of users requesting elevator service. The system can access, in response to the user input, profile data for each user in the plurality of users; access, in response to the accessing of the profile data, a shared resource in each of the plurality of elevators; and correlate, with each of the shared resources in each of the plurality of elevators, the profile data and user input. The plan can be developed, based on the correlating and the user input, to include elevator assignments for the plurality of users. The system can communicate, according to the routing plan, the elevator assignments to the plurality of users.

Embodiments of the present disclosure may be directed toward a computer system for developing a routing plan for a plurality of users requesting elevator service from a plurality of elevators. The system can comprise at least one processor circuit configured to receive, from each user in the plurality of users requesting elevator service, user input specifying a destination and a current location; access, in response to the user input, profile data for each user in the plurality of users; and access in response to the accessing of the profile data, a shared resource in each of the plurality of elevators. The circuit can be configured to correlate, with each of the shared resources in each of the plurality of elevators, the profile data and user input; develop, based on the correlating and the user input, the routing plan that includes elevator assignments for the plurality of users; and communicate, according to the routing plan, the elevator assignments for the plurality of users.

Embodiments of the present disclosure may be directed toward a computer program product for developing a routing plan for a plurality of users requesting elevator service from a plurality of elevators. The computer program product comprising a computer readable storage medium having program instructions embodied therewith, wherein the computer readable storage medium is not a transitory signal per se, the program instructions executable by a computer processing circuit to cause the circuit to perform the method comprising receiving, from each user in the plurality of users requesting elevator service, user input specifying a destination and current location. The method can further comprise accessing, in response to the user input, profile data for each user in the plurality of users; accessing, in response to the accessing of the profile data, a shared resource in each of the plurality of elevators; and correlating, with each of the shared resources in each of the plurality of elevators, the profile data and user input. Based on the correlating and the user input, the method of the instructions embodied within the computer readable storage medium of the computer program product can further comprise developing, based on the correlating and the user input, the routing plan that includes elevator assignments for the plurality of users; and communicating, according to the routing plan, the elevator assignments for the plurality of users.

The above summary is not intended to describe each illustrated embodiment or every implementation of the present disclosure.

BRIEF DESCRIPTION OF THE SEVERAL VIEWS OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
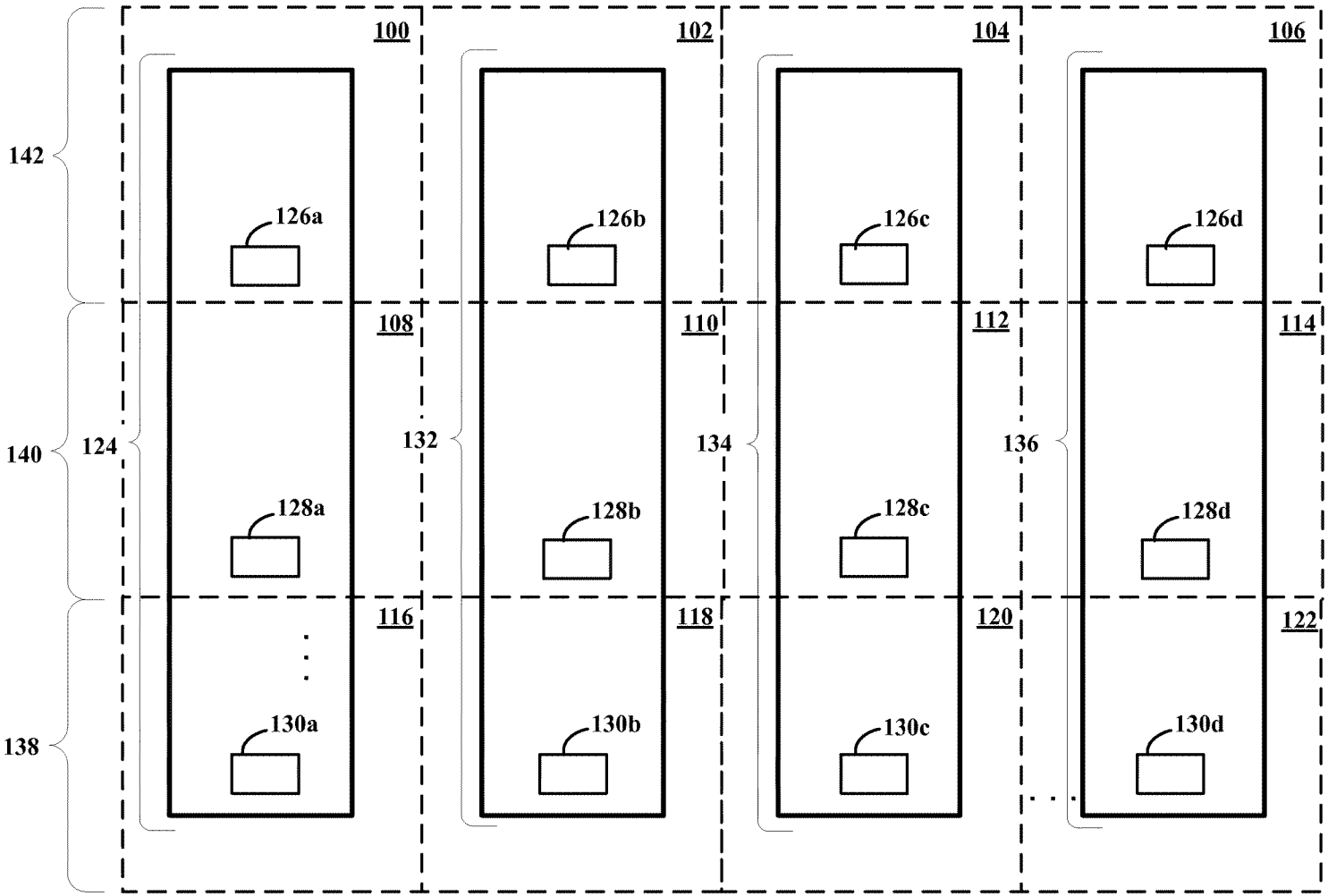
FIG. 1 depicts a view of four different elevator control systems which are controlled by an elevator dispatching system, consistent with embodiments of the present disclosure.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Aspects of the present disclosure relate to developing an elevator routing plan, and more particular aspects relate to assigning users to elevators based on factors including personalized data. While the present disclosure is not necessarily limited to such applications, various aspects of the disclosure may be appreciated through a discussion of various examples using this context.

According to various embodiments, an elevator dispatching system can assign users to elevators, and it can route the elevators according to a plan in order to reduce overall travel time. In circumstances where the system is used to assign a plurality of passengers, the passengers using a number of elevators in elevator operating systems, where the elevator operating systems are in one or more buildings, the routing plan can become very complex. An elevator dispatching system can also customize an elevator dispatching plan according to personalized data for each user, in order to solve an elevator dispatch problem. This personalized data can include items such as social media connections, internet activity, job titles, and data about the user's historical use of the particular elevator system. The elevator dispatching plan can also be customized according to bilateral preferences as indicated by a user or based on associations between users of the system. The plans developed by this system can be used to assign a plurality of users to a plurality of elevators and route them (the users and the elevators) accordingly to solve an elevator dispatch problem.

According to various embodiments, the solutions to the elevator dispatch problem can seek to allocate elevators to passengers so as to decrease the total travel time across all passengers. Consistent with some embodiments, there can be a group of elevators that serve multiple floors of a high-rise building and the problem can involve determining which elevator in the group should serve each portion of the demand at each floor, and in what order. The elevator dispatch problem can also be understood as an elevator destination control problem since systems can allow for a user to enter a desired destination floor on a keypad outside the elevator. This can allow the departure floor, the destination floor, and the number of waiting and traveling passengers to be known.

According to embodiments, the elevator dispatch problem can be formulated on a graph in which a link can be drawn between passengers and each elevator in a group, and each link can be associated with the travel time of the assignment. Constraints for the problem can capture rules that the elevator assignment can obey including, for example: the elevator should not stop at any floor where no passenger enters or exists, the elevator should not skip a floor at which a passenger wishes to alight, or the passenger should not be forced to travel in the reverse direction to his or her desired direction of travel.

Methods for dispatching elevators based on queueing theory allow for an estimation of expected waiting times. The elevator dispatch problem with known destinations can be compared to a dynamic vehicle routing problem with asymmetric distances or a basic assignment model for the static multi-elevator dispatch problem. This basic model can involve a binary variable representing the assignment of requests, a generic linear cost function, and two sets of constraints: the partitioning of requests and the partitioning of servers (i.e., elevators). A linear mixed-integer formulation to minimize the average time at which service begins for pickup locations (i.e., an elevator at a particular floor), can be used to solve the elevator dispatch problem.

Aspects of embodiments consider the numerous forms of personalization and weighted determinations using local search optimization algorithms that can be performed using destination dispatch in combination with unique person-identifying capabilities such as those afforded by a numeric keypad, badge swipe/RFID, smartphone, or others to further address the elevator dispatch problem. For example, by uniquely identifying the individual who is requesting the elevator service, priorities and customized costs can be taken into account so as to provide an overall better service. In addition to taking into account priorities, bilateral and multilateral preferences can be included as well so that pairs or groups of individuals, possibly boarding and alighting at different floors, can be matched to the same elevator.

Consistent with embodiments, a computer system can be configured to develop a routing or dispatching plan for a plurality of users requesting elevator service (herein the terms routing plan and dispatching plan may be used interchangeably). The computer system can comprise one or more computer processing circuits having one or more modules. The system can be configured to receive user input that specifies a destination and current location for each user in a plurality of users requesting elevator service. For example, a user on a first floor may input, via a keypad or in another manner, a request to travel to the twenty-third floor. This destination request, as well as the floor at which the request was made, can be communicated to and received by the system. One or more requests may be received by the system at a particular time, from any number of users on various floors within a building's system. The system could incorporate input from (and create a plan for) more than one associated building, too, but for purposes of discussion and figures, a system controlling a single building will be assumed.

Consistent with embodiments, the system can be configured to access, in response to the user input, profile data for each user in the plurality of users who have triggered the system by inputting a destination request. Profiles for each user can be built and updated based on historical use of the elevator system, a smart chip encoded badge, an accessed smartphone, or other data, as discussed herein. For example, historical use of the elevator system can include past wait time data, which indicates the duration of time the particular user experienced during previous use of the system. A history of a longer wait timing in a user's profile can increase the user's priority in the developing the routing plan. In response to accessing the profile data, the system can access a shared resource in each of the plurality of elevators. For example, this shared resource could be a screen in an elevator that displays advertisements or communicates business information. This could include user-specific advertisements, or a user interface (UI) that includes an agenda for a meeting each participant in the elevator is en route to attend.

Consistent with embodiments, the system can be configured to correlate the profile data and the user input with each of the shared resources. Using this data, the system can develop a routing plan that can include elevator assignments for each user in the plurality of users. The system can communicate these assignments for each user in the plurality of users, based on the routing plan assignments. This could be communicated via a message or number on the elevator keypad, an indicator on a UI, a message sent to a user's mobile device, or in similar manner.

FIG. 1 depicts a view of four different elevator operating systems which are all controlled by a single elevator dispatching system for developing an elevator routing plan, consistent with embodiments. For purposes herein, an elevator operating system can include the elevator, elevator shaft, the plurality of doors and opening locations at floors along the elevator's travel path, and operational mechanisms used to raise or lower the elevator.

Consistent with embodiments, the view in FIG. 1 could be a cross-sectional view of three floors of an elevator boarding area within a high rise building, with a front-facing view of sections of four elevator shafts, side by side. The elevator operating systems 124, 132, 134, and 136 shown are divided into zones 100-122, with each row 142, 140, and 138 representative of a floor on a building so that zones labeled 142 are on a floor above zones in row 140 and 138. Similarly, zones in row 140 are on a floor above the zones in row 138. Notably, neither row 142 nor row 138 is necessarily a top or bottom floor, rather, there are three different floors of the building depicted and sectioned into zones for ease of discussion. A single elevator in the 124 elevator operating system could move up from zone 116 to zone 100. The elevator of the operating system 124 could move above zone 100 or below zone 116. These zones are not necessarily part of an elevator operating system, but rather the elevator operating systems have been divided and assigned zone numbers for ease of discussion.

Each elevator operating system 124, 132, 134, and 136 (including at least an elevator, elevator shaft, and operating mechanism) can have a plurality of boarding and alighting locations, for example each floor at which an elevator can stop could be a boarding and alighting location. At each location a user interface can be present. Each user interface, here exemplar interfaces are labeled 126*a-d*, 128*a-d*, and 130*a-d*, can receive input from a user, specifying a destination floor. The UI could also indicate to the system the floor at which the user is currently waiting. The user interfaces 126*a-d*, 128*a-d*, and 130*a-d* could be screens, keypads, scanners, or another type of interface. A screen could collect and communicate information to the user, a keypad could be a more traditional elevator keypad, with buttons for each floor to allow a user to select a desired destination, and a scanner could communicate with a user's smart phone or other device that can identify the user and/or into which a user has programmed destination information. For example, a smartphone could contain the user's daily calendar, and the elevator scanner or other user interface could access the calendar and collect information about the location of the user's next appointment, and input the desired floor into the system. This could occur automatically, manually at a set time (e.g. once per day the user could confirm appointment locations and submit them to the elevator system), or manually at each trip request. For purposes of this disclosure, the real-time data collected by the system at the user's location can be considered user input.

Consistent with embodiments, the UI or point of user input collection could occur at a location other than at the floor at which the user is currently waiting. For example, a smartphone on the user, a computer screen at the user's desk, another keypad or user interface on a different floor, or another device could allow the user to input data regarding desired origination and destination to the elevator dispatching system.

Consistent with embodiments, this or other user input can include origination and destination requests. The system can also gather information about the specific user and store it in a profile, in various forms. The profile can be stored in a database that includes historical data (i.e. previous usage); the profile can comprise data collected in real-time, at the point of the user's interaction with the UI, or the data can be collected before or after the user directly interacts with the UI. Examples of collected real-time data can include user internet history, data collected from applications on a smartphone, data from a smart chip in a badge pertaining to office location or job title, and social media interactions.

Consistent with embodiments, another type of real-time data that can be collected by the system via passive or active user input, is grouping or "friend" preferences or requests. For example, a friend or grouping request could be submitted by a user via the same UI into which the destination request was submitted. The friend or grouping preference could also be detected based on profile data for a user. A grouping request could be triggered based on a set number of connections with another user over various forms of social media. Similarly, a request could be triggered if a particular user has communicated with another user a set number of times in a particular period of time. An administrator could also have pre-registered groupings or sets of "friends" based on job categories, floor associations, or other factors.

Consistent with embodiments, the system can develop a routing plan for users on various floors, where a plurality of users can input a plurality of requests (i.e. a destination request and/or a "friend" request each) via various keypads, at the same or similar times. For example, a user in zone 100 ("user 1") can enter a destination request to the system, via the UI 126*a*. The requested destination may be at a floor higher than floor 142, for example. At the same time, a second user in zone 114 ("user 2") can input a request for a destination via the UI in zone 114. User 2's destination request may be for a zone above floor 142. A third user, currently waiting in zone 118, ("user 3") can input a request into the UI in zone 118, which may request a destination below floor 138.

The elevator dispatching system can receive the requests and process them according to a number of factors. For each individual elevator request, the system can access profile data associated with the user who made the request, if profile data is available. The system can also identify whether a friend request has been made to the system by any of the users whose elevator requests are being processed. The system can also identify whether a potential friend group exists, either in the absence of an explicit friend request or in addition to the friend request.

For example, user 1 in zone 100 and user 2 in zone 144 could be identified as "friends", based on, for example, a request user 1 entered into the UI 126*a*. The grouping preference between user 1 and user 2 could also be identified by the system based on profile data accessed from each user's profile. The system could then set up the friend group accordingly. This friend group could be used as a factor in developing the elevator dispatch plan. The friend group factor could also be weighted in the elevator plan development, based on a number of other factors including historical use of the system by each of user 1 and 2, the connectedness of user 1 and user 2 on social media, or other weighting factors set by the system's administrator.

The elevator dispatch plan could also be developed according to a number of other factors. For example, advertising considerations including ways to maximize exposure of relevant advertisements to a particular set of relevant users could be used to develop the plan. Other considerations including travel time, elevator availability, priority of the user based on past elevator waiting time, job title, and origin and destination requests could be included in the development of the elevator dispatch plan. Like the friend group factor, each of these factors could be weighted.

Consistent with embodiments, the routing plan could include elevator assignments for each user, with user 1 in zone 100, being assigned to the elevator in the elevator operating system 132, with a pickup location in zone 102. User 2 could be assigned an elevator in the same elevator operating system, system 132, with a pickup location in zone 118. User 3 could be assigned an elevator in elevator control system 134, with a pickup location in zone 120. Each elevator assignment could be communicated to the respective user, via the UI into which the request was made, or through an interface on a phone, computer, or other device. Thus, the assignment would direct user 2 to the elevator in zone 118, for pickup by an upward moving elevator. The same elevator would travel upward and stop at zone 102 to allow user 1 to board. Users 1 and 2 would continue their upward trip together until they alighted at each of their respective destinations. Meanwhile, user 3 could walk to elevator control system 134, to be picked up by the elevator in that system and travel downward. The system as depicted in FIG. 1 can increase in complexity to include a plurality of users specifying a plurality of destinations and grouping requests, over a plurality of floors.

Figure 2:
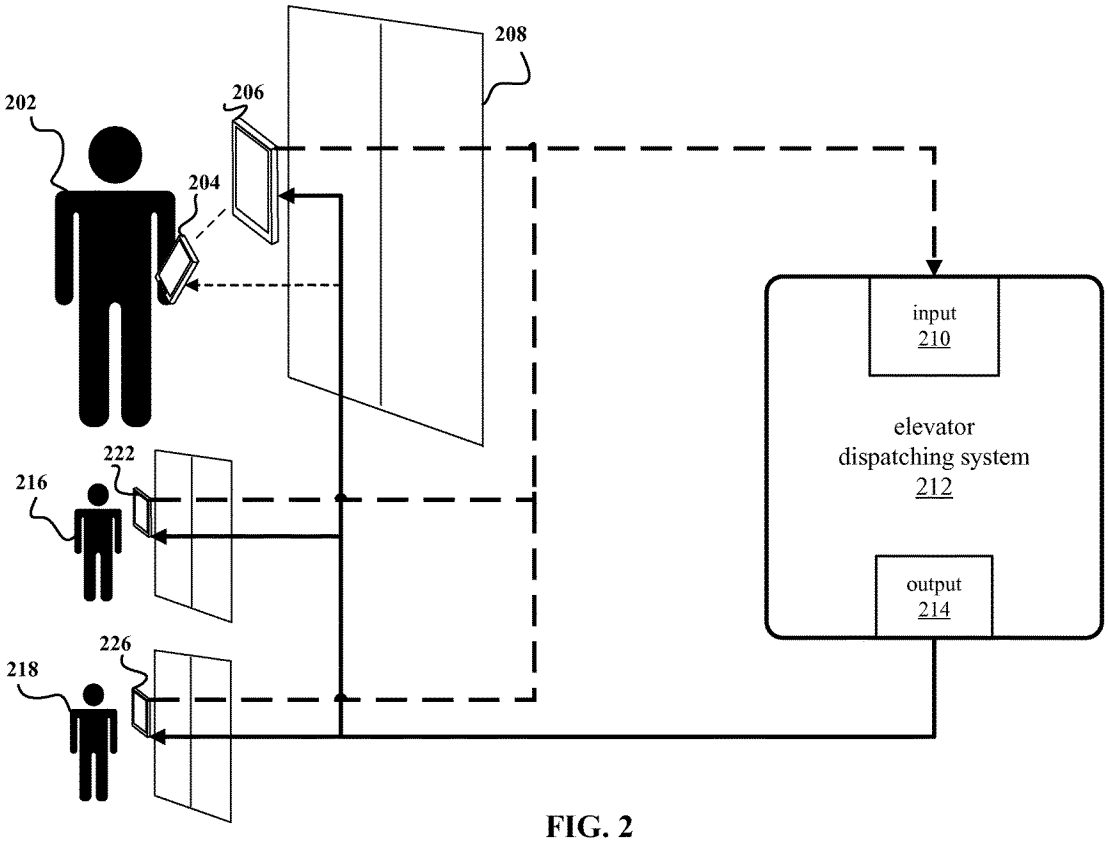
FIG. 2 depicts a functional view of the system for developing and communicating elevator routing assignments to users, consistent with embodiments of the present disclosure.

FIG. 2 depicts a functional view of the system for developing and communicating elevator routing assignments to users, consistent with embodiments. The elevator dispatching system 212 depicted here can comprise at least one computer processor circuit, which can be configured to develop an elevator routing and dispatch plan, consistent with embodiments herein. A user 202 can input a destination (i.e. floor) request into a keypad 206 at an elevator boarding point 208. The elevator boarding point can be the doorway through which an elevator user boards the elevator to travel in a particular direction. The user 202 could also enter a destination request via a mobile device like a smart phone 204. The request input via the keypad 206 or the smart phone 204 can be received by the elevator dispatching system 212, via an input port 210. This data, as well as input from a plurality of other users 216 and 218 can be received at the input port 210 of the elevator routing system 212. Each user 216 and 218, can enter a destination request into a keypad 222 and 226. The input port 210 of the elevator routing system 212 can receive the destination requests as well as access data regarding the location at which each request was made (either based on keypad location, smart phone satellite data, a mobile device reading by a keypad at a particular location, or another way). The system can also access data from a profile for each particular user. For example, profile data including user priority data like job category and past usage history can be accessed by the system 212 and used in developing an elevator routing plan. Profile data can be collected from users before, after, or during each user's destination request is received by the system 212. For example, an application on a smart phone, or a smart chip on a user badge could communicate with the system 212 directly or through the elevator keypad 206 to provide profile data.

Consistent with embodiments, based on the user input and profile data for each user, the system 212 can develop a routing plan for elevator dispatch that includes an elevator assignment for each user. Using the profile, and based on input, the plan can take into account user priority, advertising revenue potentials, and time costs for stopping at each floor, and other factors. Based on the route the system 212 generates, the elevator assignments for each user who input a destination request can be communicated via an output port 214.

As mentioned herein, some users may be assigned a "later" elevator, and thus will not receive an elevator assignment communication immediately, but will be assigned to a next routing plan. Each assignment could range from simple to complex. For example, a simple assignment could instruct a user to board an elevator at a boarding point labeled "3", which could be the boarding point at which the user input the data (i.e. instructing the user to wait at his or her current location). A more complex assignment could include providing the user with multiple options and the associated arrival to destination times. The multiple options could include plans that provide the user the option to take the stairs to a higher or lower level or move to an elevator across the hall or building. These assignments could be communicated and updated from the output port 214 to each user's mobile device 204, or to each keypad 206, 222, or 226, or a combination of the two, or in another way, depending on user or system-controlled settings.

Figure 3:
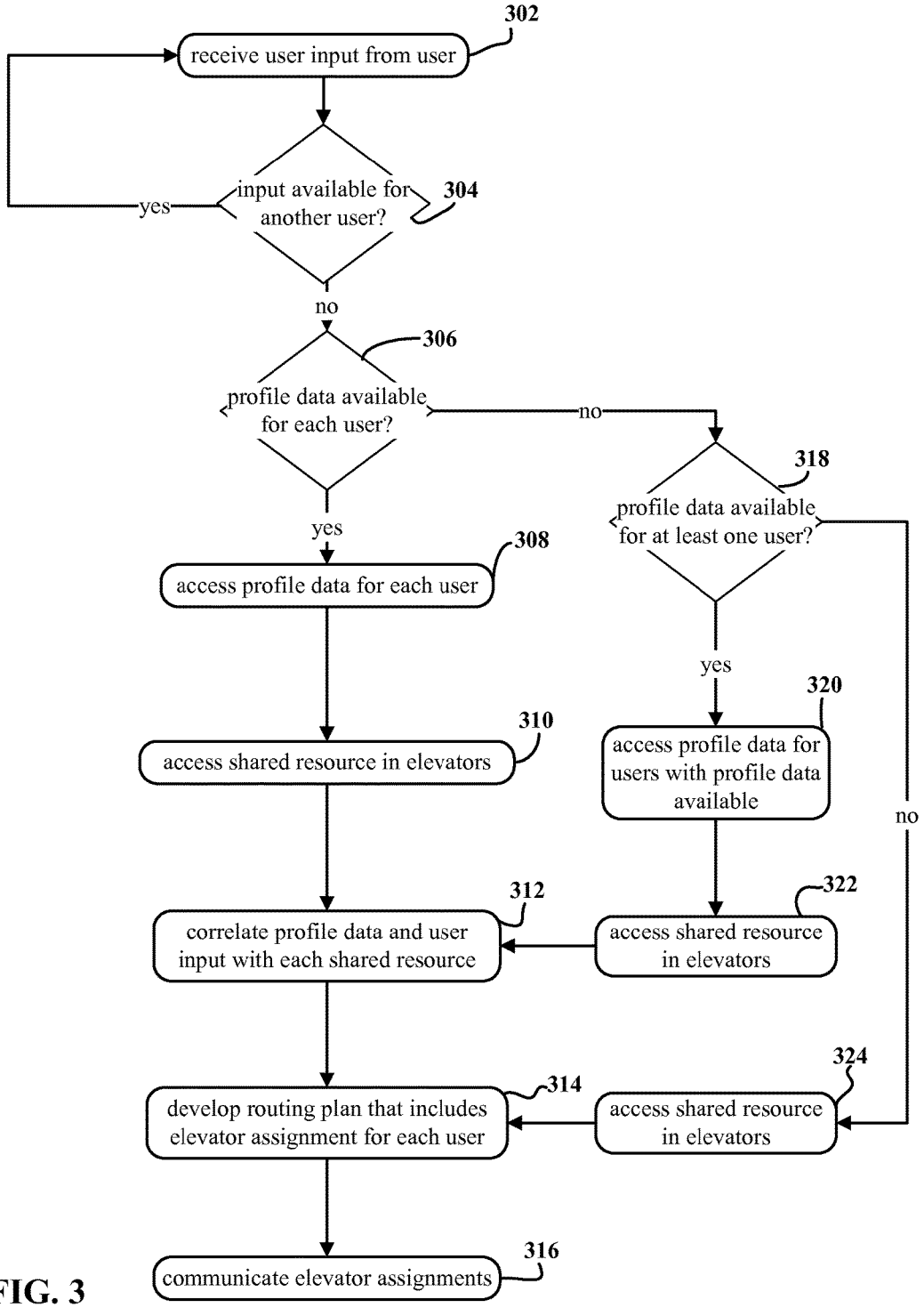
FIG. 3 depicts a flow diagram of a method for developing a routing plan for a plurality of users requesting elevator service from a plurality of elevators, consistent with embodiments of the present disclosure.

FIG. 3 depicts a flow of a method for developing a routing plan for a plurality of users requesting elevator service from a plurality of elevators in an elevator dispatching system, consistent with embodiments. Per 302, the flow can begin when the system receives user input from a single user. The system can monitor and collect inputs from an additional user, per 304. If input from an additional user is detected, the system can receive the input, per 302 and continue to monitor for input from another user, per 304. Once the system determines that no additional user input is available at the time, or once a time or user number threshold is met, the system can scan for profile data for each user per 306. This profile data can be located in a stored data repository within the system or in a repository accessible by the system. The profile data can also be collected in real-time, through a user's smart phone, via a user's smart chip-embedded badge, or in another way. If profile data is available for each user, the data can be accessed, per 308.

Consistent with embodiments, once all available relevant profile data has been accessed by the system, shared resources in each elevator in the system can be accessed, per 310. This shared resource could be a screen, for example a TV screen that plays advertisements or a touchpad screen which provides information to a passenger or group of passengers on an elevator. The system can correlate profile data from each user and user input with each shared resource, per 312. This step allows the system to associate the input received from a particular user, with the accessed profile data for a particular user, for each user, and then to associate this data with the shared resources in each elevator. Each shared resource could be a screen, as mentioned above, and it could also include resource data, such as various parameters or requirements that have been supplied by a system administrator that correlate to particular advertising revenue-based requirements.

Consistent with embodiments, once this data has been correlated, per 312, a routing plan that includes an elevator assignment for each user can be developed, per 314. This plan can be developed in a number of ways and can include personalization factors mentioned herein including job category, friend preferences, priority based on past wait time and usage, or other factors. It can also include factors of distances of travel requested, current floor, and number of other passengers. The elevator assignments developed according to the routing plan can be communicated, per 316. According to embodiments, these can be communicated directly to the user via a smart phone application or another feature on another device. They could also be communicated internally to the elevator control systems and displayed on the keypad which the user entered destination request data. The user assignments could also be communicated and displayed to users via a centrally located screen (i.e. similar to an arrival/departure screen at an airport terminal).

Consistent with embodiments, if profile data is not available for each user, but profile data is available for at least one user, per 318, the system can access the profile data for each of the one or more users with an available profile, per 320. Shared resources in the elevators can be accessed, per 322, correlated with the profile data and user input, per 312, and used to develop the routing system as described herein, per 314. If profile data is not available for at least one user, at decision 318, the system can access a shared resource in the elevators, per 324. At this point, the system can merge with the branch of the system operating when a profile is available for each user, and develop a routing plan that includes an elevator assignment for each user, per 314. As indicated above, the assignments and other information can be communicated to the user, per 316.

Figure 4:
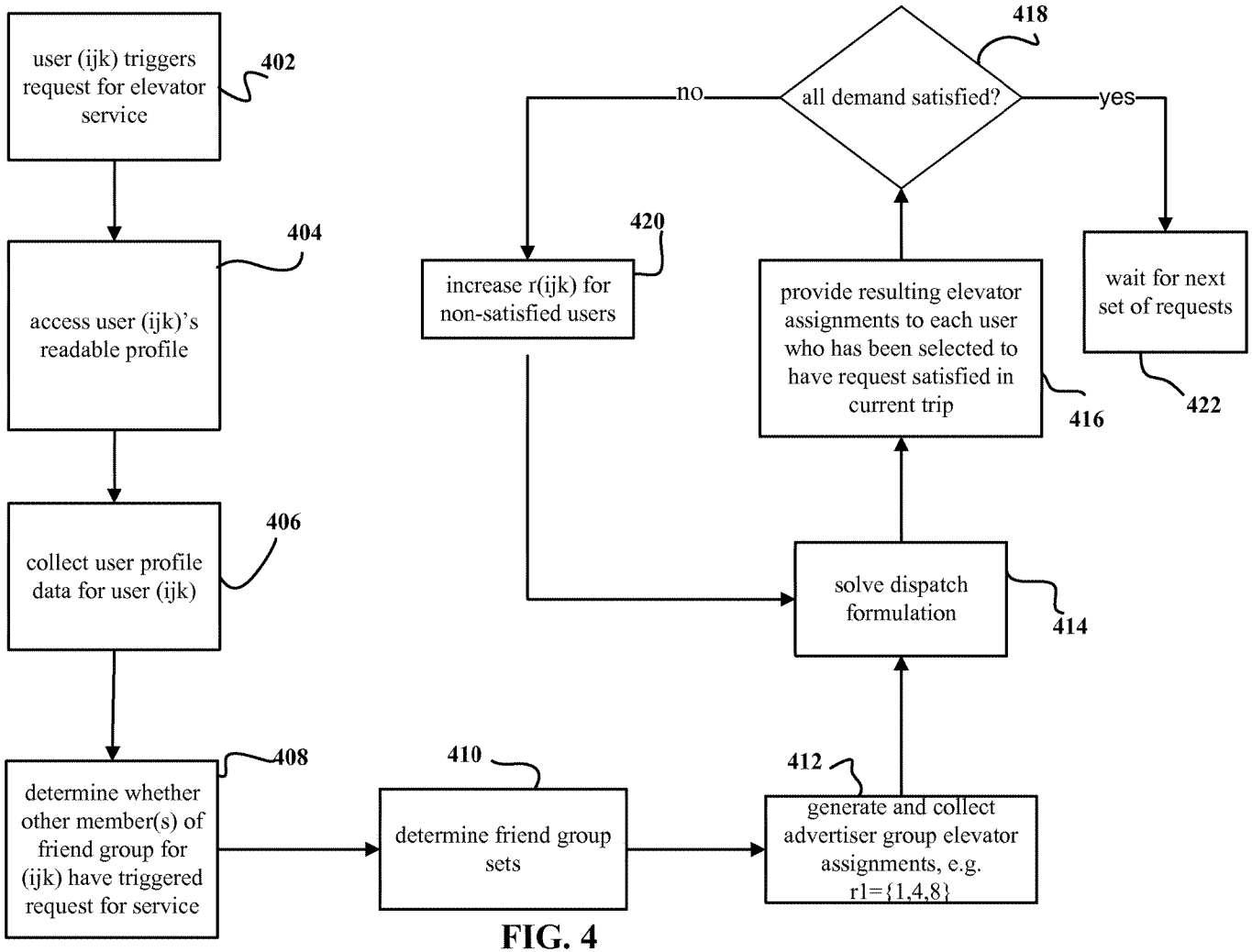
FIG. 4 depicts a flow diagram for generating and assigning elevator assignments to a set of users, consistent with embodiments of the present disclosure.

FIG. 4 depicts a flow diagram for generating and assigning elevator assignments to a set of users, consistent with embodiments of the present disclosure. The flow begins when a user triggers a request for elevator service, per 402. In this example, the user can be identified by the variables (i,j,k), which can indicate the user's current floor ("i"), the user's desired floor (i.e. destination)("j"), and a unique identifier for the particular user ("k"), respectively. Upon the triggering event, the system can access the particular user, a readable profile for user (i,j,k), per 404. If the particular user (i,j,k) has a readable profile, the system can collect user profile data for the particular user (i,j,k) pertaining to the user's priority within the system, and other data to be used in generating the elevator routing plan, per 406. The system can then detect whether other members in user (i,j,k) friend group have triggered requests for elevator service, per 408. A friend group could be identified based on a specified request by a user. The friend group could also be identified based on job category, specified system-end designation, or a pre-registered designation by one or more users. A friend group could also be identified based on a user's social media presence, with different weights for friend groups being assigned based on a determined social media "proximity". For example, a user who is connected to others in a friend group via "friend" status on FACEBOOK or "follower" status on INSTAGRAM, for example, could be given a higher preference than someone only in the same "network" as the others in the friend group. Moreover, increased user interaction with specific friends in the friend group could increase the preference of a particular user, over someone who was merely a "friend" on social media.

Consistent with embodiments, and based upon the above and other factors, sets of friend groups could be determined, per 410. These sets could include all the different options for the friends and friend groupings. Each set could be assigned a weight or number, which could be reflective of the desirability of the friend grouping, according to the weighting and factoring system. The system could then generate and collect advertising group elevator assignments, per 412. For example, r1={1,4,8}, where r could indicate the add group set identifier, here "1", and {1,4,8} could indicate the elevator identifiers, thus assigning the users in group set "1" to elevators "1", "4", and "8".

Consistent with embodiments, the system can then develop an elevator routing plan by solving a dispatch formulation, in order to factor in user input, user profile data, friend group consideration, adverting generation, and other factors, per 414. The resulting elevator assignments can then be communicated to each user who has been selected to have a request satisfied in the current trip, by the use of the current formulation, per 416. If demand has then been satisfied (i.e. all users who specified a destination request were factored into the formulation), per 418, then the system can wait for the next set of requests, per 422. However, if all demand has not been satisfied, per 418 to 420, the system can increase one of the weighting factors, here r(i,j,k) for the non-satisfied user, and solve the dispatch formulation, per 414, in order to develop a plan that includes the previously unassigned user, and the assignments generated by the solving of the formulation can be communicated to each user, per 416.

Consistent with embodiments, a binary integer programming formulation can allow the features disclosed herein to be provided by an elevator system. The formulation provided is for a single elevator. A multiple elevator case can be a straightforward extension in which an additional index is used to represent the elevator in question, and the summation over the elevators as well. The model assumes that it will be resolved in real-time and includes service for a vertical direction, up or down. The choice is therefore whether on the current trip of the elevator up or down, a passenger request is to be served. If the request is not served, it remains in the pool and can be served on a later trip of the elevator in the same direction.

Consistent with embodiments, in order to take into account personalization, a decision variable must be associated with each individual or user requesting the service. Let $x_{ijk}=1$ if individual k at floor i requests service to floor j. A priority is associated with each individual, the priority, $p_{ijk}$, represents the benefit of serving the individual. While an individual is referred to as (i,j,k) in the formulations, it is assumed that a unique identifier, such as an employee serial number, is associated with each individual so as to link other job role characteristics to the user's profile.

The variable $y_i=1$ if the elevator stops at floor i to board passengers and $z_j=1$ if the elevator stops at floor j to alight passengers. n can be the number of floors served by the elevator. The elevator itself has a capacity, c. The time taken for the elevator to stop and board passengers can be designated $t^b$ and the time taken to stop and alight passengers can be $t^a$. In addition to the fixed cost (time) of stopping at floor i, there is a marginal cost per passenger boarding or alighting, called dt.

This formulation permits the incorporation of other potentially desirable features of the personalized elevator dispatch including enabling bilateral preferences, for example "friends" can request to ride in the same elevator. Sets of registered pairs of "friends" can be defined as $f_1$=(i,j,k), $f_2$=(i',j',k',), with F such registered pairs. The matrix of importance of the pair riding in the same elevator can be defined as β where ,$\beta f_1,f, \in \mathbb{R}$ (note that the value of the weight can be positive or negative). An additional decision variable can be used to handle the "friend" constraints, $wf_1,f_2 \in \{0,1\}$ for each registered friend.

For example, the following constraints are defined for the upwards trip of the elevator, so that (i,j,k) is a passenger served from floor i to floor j and the range i≤j refers to floors already passed by the elevator, whether served or not. On the downward trip, the inequality can be reversed, to indicate that the floors i≥j have been visited already. $K_{ij}$ is the total number of users at the given point in time having made a request to go from floor i to floor j.

In this example, capacity constraints of the elevator can be given by:

$$\sum_{j\le i}\sum_{l>i}\sum_{k=1\ldots K_{ij}} x_{jlk} \le c,\ i=1\ldots n-1. \tag{1}$$

The fixed cost for boarding passengers at floor i needs to be paid only if passengers are actually boarded at floor i, thus:

$$\sum_{j=1\ldots n}\sum_{k=1\ldots K_{ij}} x_{ijk} \ge y_i,\ i=1\ldots n. \tag{2}$$

Similarly, an analogous constraint is needed for the definition of $z_j$:

$$\sum_{i=1\ldots n}\sum_{k=1\ldots K_{ij}} x_{ijk} \geq z_j,\ j=1\ldots n. \tag{3}$$

To ensure the benefit of respecting the "friends" requests is only obtained when both "friends" are served, the following can be applied:

$$x_{i,j,k}+x_{i',j',k}\geq 2w_1, l=1\ldots F, \tag{4}$$

where $w_1=w_{(i,j,k),(i',j',k')}$.

All variables are binary, so that:

$$x_{i,j,k}, y_i, z_i, w_l \in \{0,1\}, l=1,\ldots K_{ij} i,j=1\ldots n. \tag{5}$$

In this example and consistent with embodiments, an objective is to find a high or highest net benefit of serving the passengers who have requested elevator service, where the benefit comes from the individual priorities of serving each passenger, the advertising revenue, and the cost to both a passengers-specific boarding and/or alighting time penalty as well as a fixed cost for stopping at a floor. Thus, the function to find the high or highest benefit for the upward trip can be:

$$\max_{w,x,y,z} Z = \sum_{i=1\ldots n}\sum_{j=i+1\ldots n}\sum_{k=1\ldots K_{ij}}\sum_{m=1\ldots M}\sum_{r=1\ldots R}(p_{ijk}/T_{ijk}+v_{ijkr}-2dt)x_{ijkm} - \sum_{i=1\ldots n}\sum_{m=1\ldots M} t_b y_{im} + t_a z_{im} + \sum_{l=1\ldots F}\beta_l w_l, \tag{6}$$

where $w_1=w_{(i,j,k),(i,j,k)}$. For the downward trip, the second summation goes from n . . . i.

In some cases it may be important to take into account nonlinearly-increasing times for boarding and alighting as a function of the number of passengers. This results in the following convex quadratic binary objective function:

$$\max_{w,x,y,z} Z = \sum_{i=1\ldots n}\sum_{j=i+1\ldots n}\sum_{k=1\ldots K_{ij}}\sum_{m=1\ldots M}\sum_{r=1\ldots R}(p_{ijk}/T_{ijk}+v_{ijkr})x_{ijkm} - \sum_{i=1\ldots n}\sum_{m=1\ldots M} t_b y_{im} + t_a z_{im} - \sum_{m=1\ldots M} g(p_m, v_m) f\left(\sum_{i=1\ldots n}\sum_{j=i+1\ldots n}\sum_{k=1\ldots K_{ij}} x_{ijkm}\right) + \sum_{l=1\ldots F}\beta_l w_l. \tag{7}$$

The following can provide sample data, in order to provide additional understanding of the provided exemplar formulation. Suppose that the elevator parameters are given by:

| $t^b$ | $t^a$ | c |
|---|---|---|
| 1.5 | 1.6 | 12 |

Consider the following table of parameters and characteristics of the potential passengers at the given point in time:

| i | j | k | $p_{ijk}$ | Job category | Employee ID |
|---|---|---|---|---|---|
| 1 | 2 | 1 | 0.1 | Level 7 | 31432 |
| 1 | 5 | 1 | 0.2 | Level 8 | 47892 |
| 1 | 23 | 1 | 0.1 | Level 7 | 78320 |
| 1 | 23 | 2 | 0.1 | Level 7 | 89334 |
| 1 | 28 | 1 | 0.2 | Level 8 | 31112 |
| 1 | 28 | 2 | 0.1 | Level 7 | 99734 |
| 1 | 42 | 1 | 0.3 | Level 9 | 86555 |
| 1 | 42 | 2 | 1 | Level 10 | 31227 |
| 1 | 42 | 3 | 0.9 | Level 9 | 31798 |
| 1 | 42 | 4 | 0.5 | Level 10 | 33968 |
| 3 | 15 | 1 | 0.1 | Level 7 | 56987 |
| 4 | 31 | 1 | 0.1 | Level 7 | 77874 |
| 5 | 42 | 1 | 0.7 | Level 10 | 56598 |
| 5 | 42 | 2 | 0.7 | Level 10 | 46598 |
| 5 | 42 | 3 | 10 | Level C | 33741 |
| 5 | 42 | 4 | 0.5 | Level 10 | 78550 |

For example, the values in column "i" can reflect the originating floor for the particular user, the values in column "j" can reflect the requested destination for the particular user, and "k" can indicate an identifying user number (e.g. in order to distinguish between two users starting at floor 1 and requesting to travel to floor 28. The values in the column "$p_{ijk}$" can indicate a priority associated with the user (i,j,k). The "job category" and "employee ID" columns indicate a job level and employee ID for each user, respectively.

Consistent with embodiments, the following registered groups of bilateral preference could be processed by the system:

| $f_1$ = (i, j, k) | $f_2$ = (i', j', k') | $\beta_{f1,f2}$ |
|---|---|---|
| (1, 23, 2) | (1, 28, 1) | 0.5 |
| (1, 42, 2) | (5, 42, 3) | 5 |
| (1, 42, 3) | (5, 42, 2) | −0.7 |

In this table, each value in the first column can represent a first "friend" in a friend pairing. The values in the second column can represent the second "friend" in the friend pairing. The variables "i", "j", "k" represent the same user-identifiying information as indicated in the table above. The values in the third column indicate the postive or negative weighting or importance of the pairing in the development of the dispatch plan.

Advertising target groups may be assigned as illustrated in the following, where there are three target groups and seven elevators.

| Ad group set ID, r | Ad group set (elevator IDs, m) |
|---|---|
| 1 | {3, 6} |
| 2 | {2, 5} |
| 3 | {1, 4, 7} |

These data could be used in solving an exemplary formulation for developing an elevator dispatch plan based on personalized user data.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

It is understood in advance that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as Follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as Follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as Follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure comprising a network of interconnected nodes.

Figure 5:
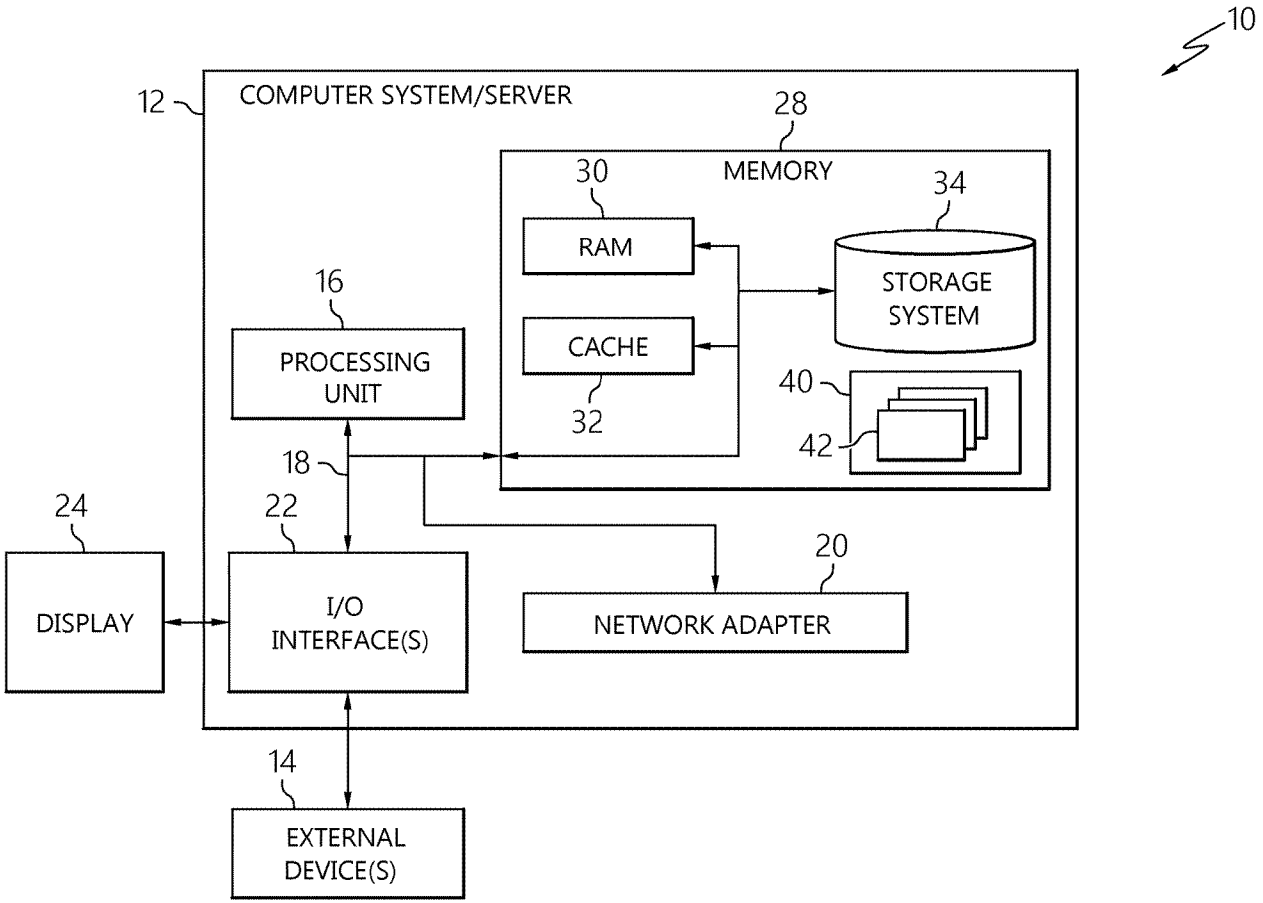
FIG. 5 depicts a cloud computing node according to an embodiment of the present invention.

Referring now to FIG. 5, a schematic of an example of a cloud computing node is shown. Cloud computing node 10 is only one example of a suitable cloud computing node and is not intended to suggest any limitation as to the scope of use or functionality of embodiments of the invention described herein. Regardless, cloud computing node 10 is capable of being implemented and/or performing any of the functionality set forth hereinabove.

In cloud computing node 10 there is a computer system/server 12, which is operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 12 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 5, computer system/server 12 in cloud computing node 10 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the invention.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, device drivers, redundant processing units, external disk drive arrays, RAID systems, tape drives, and data archival storage systems, etc.

Figure 6:
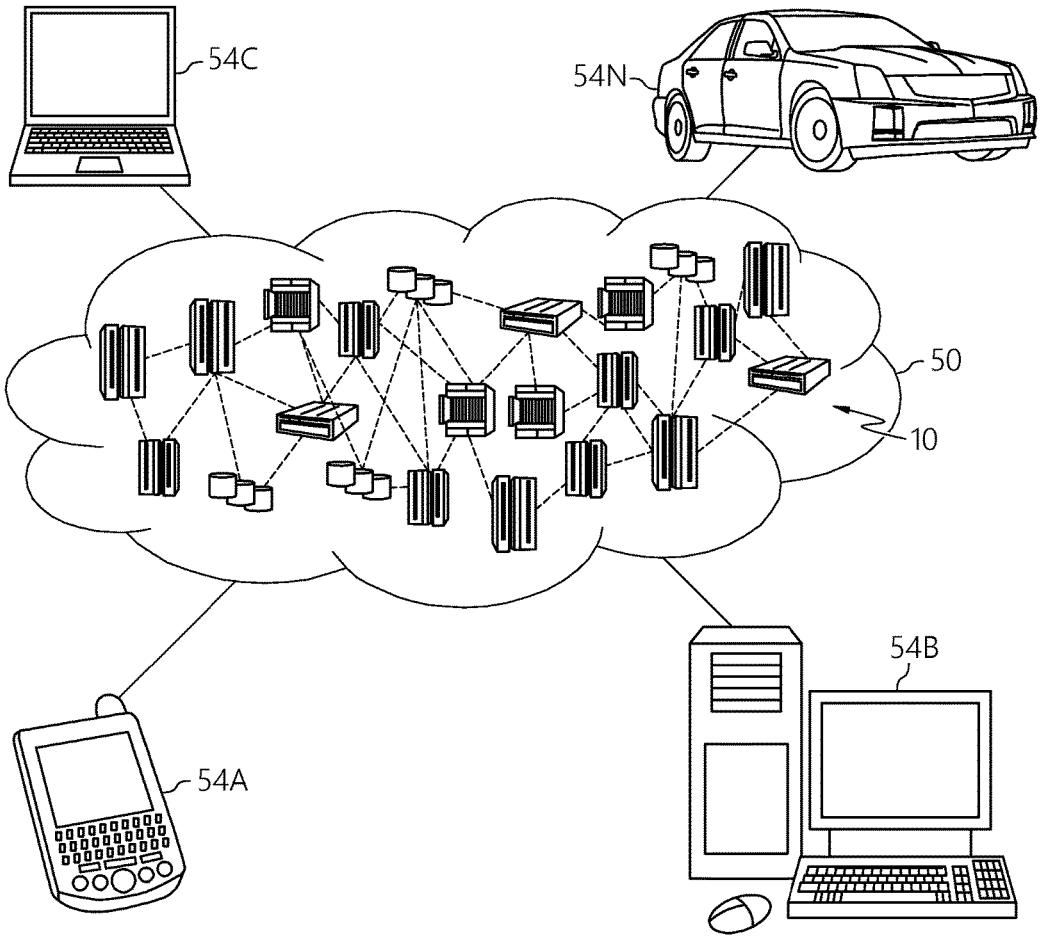
FIG. 6 depicts a cloud computing environment according to an embodiment of the present invention.

Referring now to FIG. 6, illustrative cloud computing environment 50 is depicted. As shown, cloud computing environment 50 comprises one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 6 are intended to be illustrative only and that computing nodes 10 and cloud computing environment 50 can communicate with any type of computerized device over any type of network and/or network addressable connection (e.g., using a web browser).

Figure 7:
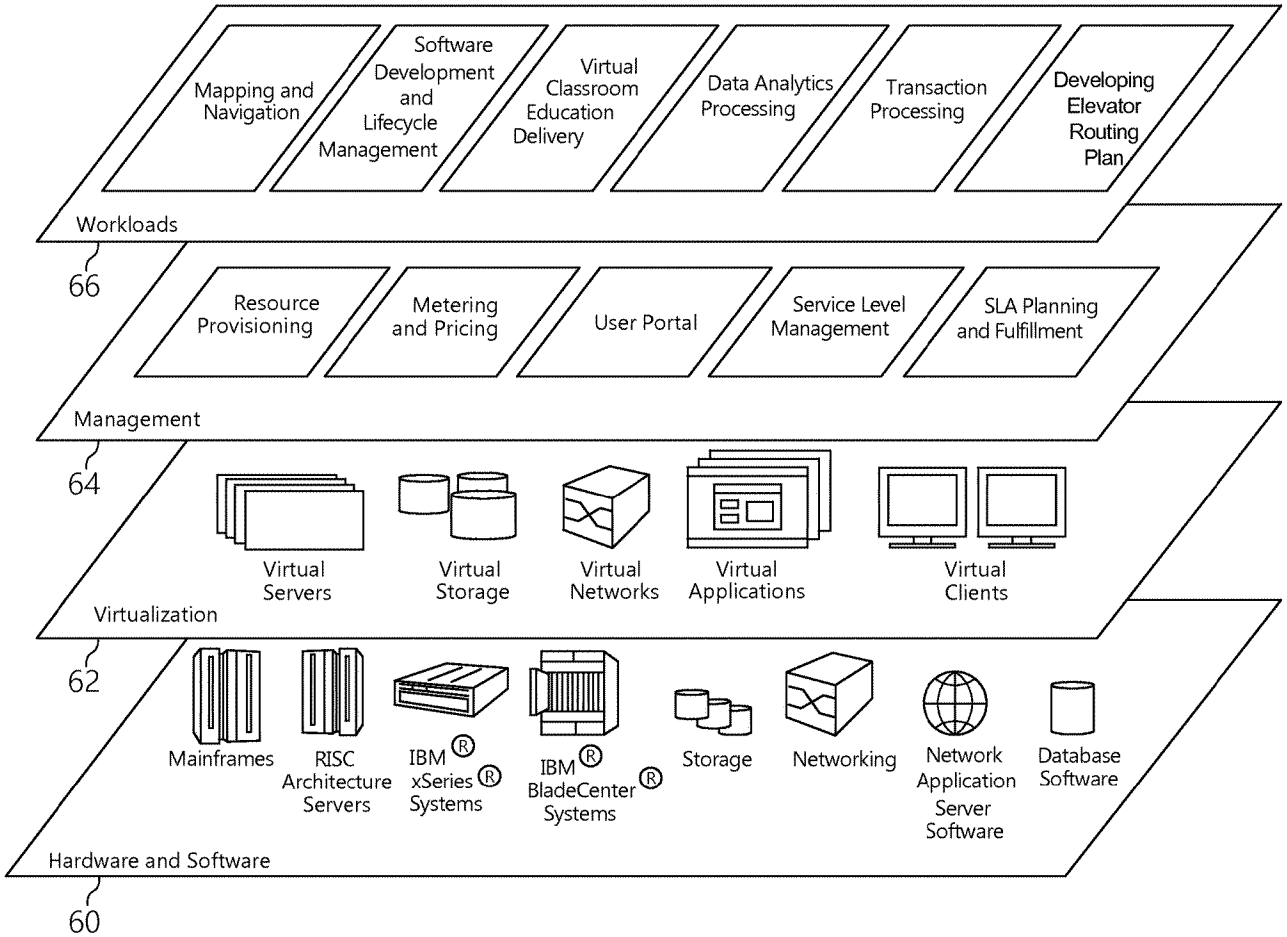
FIG. 7 depicts abstraction model layers according to an embodiment of the present invention.

Referring now to FIG. 7, a set of functional abstraction layers provided by cloud computing environment 50 (FIG. 6) is shown. It should be understood in advance that the components, layers, and functions shown in FIG. 7 are intended to be illustrative only and embodiments of the invention are not limited thereto. As depicted, the following layers and corresponding functions are provided:

Hardware and software layer 60 includes hardware and software components. Examples of hardware components include: mainframes; RISC (Reduced Instruction Set Computer) architecture based servers; storage devices; networks and networking components. In some embodiments, software components include network application server software.

Virtualization layer 62 provides an abstraction layer from which the following examples of virtual entities may be provided: virtual servers; virtual storage; virtual networks, including virtual private networks; virtual applications and operating systems; and virtual clients.

In one example, management layer 64 may provide the functions described below. Resource provisioning provides dynamic procurement of computing resources and other resources that are utilized to perform tasks within the cloud computing environment. Metering and Pricing provide cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal provides access to the cloud computing environment for consumers and system administrators. Service level management provides cloud computing resource allocation and management such that required service levels are met. Service Level Agreement (SLA) planning and fulfillment provide prearrangement for, and procurement of, cloud computing resources for which a future requirement is anticipated in accordance with an SLA.

Workloads layer 66 provides examples of functionality for which the cloud computing environment may be utilized. Examples of workloads and functions which may be provided from this layer include: mapping and navigation; software development and lifecycle management; virtual classroom education delivery; data analytics processing; transaction processing; and developing an elevator routing plan and communicating assignments to users according to the plan.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A computer implemented method for developing a routing plan for a plurality of users requesting elevator service from a plurality of elevators, the method comprising:

receiving, from each user in the plurality of users requesting elevator service, user input specifying a destination and a current location;

accessing, in response to the user input, profile data for each user in the plurality of users;

accessing, in response to the accessing of the profile data, a shared resource in each of the plurality of elevators;

correlating, with each of the shared resources in each of the plurality of elevators, the profile data and the user input;

developing, based on the correlating and the user input, the routing plan that includes elevator assignments for the plurality of users; and communicating, according to the routing plan, the elevator assignments to the plurality of users.

2. The method of claim 1, wherein the profile data for a particular user is collected by:

receiving, from the particular user's mobile device, identifying information for the particular user; and accessing, based on the identifying information and relative to the plurality of elevators, elevator use history data for the particular user.

3. The method of claim 2, wherein the collecting of profile data further comprises:

accessing, in response to the identifying information for the particular user, internet use history for the particular user, including social media use and social media connections to other users in the plurality of users; and updating, based on the particular user's internet use history, social media use and social media connections, the profile data.

4. The method of claim 1, wherein the user input further specifies a bilateral preference for another user in the plurality of users.

5. The method of claim 1, wherein the profile data for another particular user in the plurality of users, in response to waiting time for an elevator in the plurality of elevators, is updated to reflect the other particular user's waiting time.

6. The method of claim 5, wherein an increase in the waiting time in the profile data for the other particular user results in an increase in priority of the other particular user.

7. The method of claim 1, wherein in response to profile data for each user in the plurality of users not being accessible, the method further comprises:

accessing, in response to the user input, profile data for some of the users in the plurality of users;

accessing, in response to the accessing of the profile data, a shared resource in each of the plurality of elevators;

correlating, with each of the shared resources in each of the plurality of elevators, the profile data for some of the users and user input from each user in the plurality of users requesting elevator service; and developing; based on the correlating and the user input, the routing plan that includes elevator assignments for each user in the plurality of users.

8. A computer system for developing a routing plan for a plurality of users requesting elevator service from a plurality of elevators, the system comprising:

at least one processor circuit configured to:

receive, from each user in the plurality of users requesting elevator service, user input specifying a destination and a current location;

access, in response to the user input, profile data for each user in the plurality of users;

access, in response to the accessing of the profile data, a shared resource in each of the plurality of elevators;

correlate, with each of the shared resources in each of the plurality of elevators, the profile data and the user input;

develop, based on the correlating and the user input, the routing plan that includes elevator assignments for the plurality of users; and communicate, according to the routing plan, the elevator assignments for the plurality of users.

9. The system of claim 8, wherein the circuit is further configured to collect the profile data for a particular user by:

receiving, from the particular user's mobile device, identifying information for the particular user; and accessing, based on the identifying information and relative to the plurality of elevators, elevator user history data for the particular user.

10. The system of claim 9, wherein the circuit is further configured to collect the profile data for the particular user by:

accessing, in response to the identifying information for the particular user, internet use history for the particular user, including social media use and social media connections to other users in the plurality of users; and updating, based on the particular user's internet use history, social media use and social media connections, the profile data.

11. The system of claim 8, wherein the user input further specifies a bilateral preference for another user in the plurality of users.

12. The system of claim 8, wherein the circuit is further configured to, update the profile data for another particular user in the plurality of users, in response to waiting time for an elevator in the plurality of elevators, to reflect the other particular user's waiting time.

13. The system of claim 12, wherein the circuit is further configured to increase priority of the other particular user, in response to an increase in the waiting time in the profile data for the other particular user.

14. The system of claim 8, wherein, in response to profile data for each user in the plurality of users in not accessible, the circuit is further configured to:

access, in response to the user input, profile data for some of the users in the plurality of users;

access, in response to the accessing of the profile data, a shared resource in each of the plurality of elevators;

correlate, with each of the shared resources in each of the plurality of elevators, the profile data for some of the users and user input from each user in the plurality of users requesting elevator service; and develop, based on the correlating and the user input, the routing plan that includes elevator assignments for each user in the plurality of users.

15. A computer program product for developing a routing plan for a plurality of users requesting elevator service from a plurality of elevators, the computer program product comprising a computer readable storage medium having program instructions embodied therewith, wherein the computer readable storage medium is not a transitory signal per se, the program instructions executable by a computer processing circuit to cause the circuit to perform the method comprising:

receiving, from each user in the plurality of users requesting elevator service, user input specifying a destination and current location;

accessing, in response to the user input, profile data for each user in the plurality of users;

accessing, in response to the accessing of the profile data, a shared resource in each of the plurality of elevators;

correlating, with each of the shared resources in each of the plurality of elevators, the profile data and the user input;

developing, based on the correlating and the user input, the routing plan that includes elevator assignments for the plurality of users; and communicating, according to the routing plan, the elevator assignments for the plurality of users.

16. The computer program product of claim 15, wherein the profile data for a particular user is collected by:

receiving, from the particular user's mobile device, identifying information for the particular user; and accessing, based on the identifying information and relative to the plurality of elevators, elevator use history data for the particular user.

17. The computer program product of claim 16, wherein the profile data for the particular user is further collected by:

accessing, in response to the identifying information for the particular user, internet use history for the particular user, including social media use and social media connections to other users in the plurality of users; and updating, based on the particular user's internet use history, social media use and social media connections, the profile data.

18. The computer program product of claim 15, wherein the user input further specified a bilateral preference for another user in the plurality of users.

19. The computer program product of claim 15, wherein the profile data for another particular user in the plurality of users, in response to waiting time for an elevator in the plurality of elevators, is updated to reflect the other particular user's waiting time.

20. The computer program product of claim 19, wherein an increase in the waiting time in the profile data for the other particular user results in an increase in priority of the other particular user.

* * * * *